US006836899B1

(12) United States Patent
Glasmire

(10) Patent No.: US 6,836,899 B1
(45) Date of Patent: Jan. 4, 2005

(54) DEVICE FOR DETACHABLY HOLDING AN ABSORBENT NAPKIN ACROSS THE TORSO

(76) Inventor: Samuel G. Glasmire, 146 Bentwood Cir., Bath, PA (US) 18014-8224

( * ) Notice: Subject to any disclaimer, the term of this patent is extended or adjusted under 35 U.S.C. 154(b) by 167 days.

(21) Appl. No.: 10/339,710

(22) Filed: Jan. 9, 2003

(51) Int. Cl.[7] ..... A45F 5/04

(52) U.S. Cl. ..... 2/52; 2/336; 2/323; 24/9; 24/303; 24/3.4

(58) Field of Search ..... 2/52, 50, 51, 46–48, 2/104, 309, 310, 49.1–49.5, 314, 315, 323, 335, 336, 338, 340; 24/3.4, 3.12, 303, 7, 9, 3.13, 489, 298–302, 521, 564, 530–532; 224/257, 258, 183

(56) References Cited

U.S. PATENT DOCUMENTS 675,108 A * 5/1901 Perkins ..... 24/9
1,483,338 A * 2/1924 Dilling ..... 2/52
1,551,829 A * 9/1925 Maxwell ..... 24/299
2,557,399 A * 6/1951 Teetor ..... 40/124.04
2,571,888 A * 10/1951 Jesse ..... 2/49.1
2,654,929 A * 10/1953 Feibelman ..... 24/303
2,820,269 A * 1/1958 Wolff ..... 24/9
2,865,069 A * 12/1958 Gamble ..... 24/9
3,010,110 A * 11/1961 Kirk ..... 2/49.1
3,027,617 A * 4/1962 Gray ..... 24/303
3,063,118 A * 11/1962 Salter et al. ..... 24/303
3,220,018 A * 11/1965 Johnson ..... 2/310
3,256,529 A * 6/1966 Panepinto ..... 2/301
3,529,328 A * 9/1970 Davison ..... 24/303
3,557,583 A * 1/1971 Amann ..... 68/181 R
3,619,816 A * 11/1971 Cowen ..... 2/48
3,629,905 A * 12/1971 Cote ..... 24/30.5 R
3,741,376 A * 6/1973 Brown et al. ..... 206/5
4,021,891 A * 5/1977 Morita ..... 24/303
4,255,837 A * 3/1981 Holtz ..... 24/303
4,258,493 A * 3/1981 Kettlestrings et al. ..... 40/600
4,447,238 A * 5/1984 Eldridge, Jr. ..... 24/303
4,812,064 A * 3/1989 Hatakeyama et al. ..... 400/622
5,052,055 A * 10/1991 Mysliwiec ..... 2/48
5,186,373 A * 2/1993 Taylor ..... 224/183
5,267,374 A * 12/1993 Drake ..... 24/30.5 R
5,414,903 A * 5/1995 Porteous ..... 24/9
5,425,160 A * 6/1995 Krapf ..... 24/67 R
5,450,658 A * 9/1995 Hicks ..... 24/303
D378,531 S * 3/1997 Szikszay ..... D19/65
5,682,653 A * 11/1997 Berglof et al. ..... 24/303
5,852,849 A * 12/1998 Lansing et al. ..... 24/3.4
5,895,018 A * 4/1999 Rielo ..... 248/206.5
5,926,925 A * 7/1999 Hicks ..... 24/303
6,101,688 A * 8/2000 Marchesi ..... 24/303
6,226,842 B1 * 5/2001 Wong ..... 24/303
6,282,760 B1 * 9/2001 Mars ..... 24/303
D448,703 S * 10/2001 Lam ..... D11/200
6,760,956 B1 * 7/2004 Lee et al. ..... 24/3.12

* cited by examiner

*Primary Examiner*—A. Vanatta
(74) *Attorney, Agent, or Firm*—Charles A. Wilkinson

(57) ABSTRACT

A napkin holder formed of two pairs of magnetic securing devices attached in a laterally movable arrangement with respect to each other on the outer ends of a partially neck encircling lanyard. The magnetic securing devices are formed of plastic tabs movable laterally with respect to each other, one tab having an embedded magnet and the other having a magnetizable slug embedded in it. The napkin holder may be supplied with at least one napkin to be used with it in a package designed to provide an immediately usable combination product.

23 Claims, 5 Drawing Sheets

22
30

22a
30
40

22b
30
44

30
48

22c
45

30
48a 30
22a
40

30
22b
44

30
48

30

22d
44a 22e
44b

DEVICE FOR DETACHABLY HOLDING AN ABSORBENT NAPKIN ACROSS THE TORSO

BACKGROUND OF THE INVENTION

1. Field of the Invention

The present invention relates to the field of protective coverings and more particularly to devices for holding an absorbent paper or cloth napkin or similar protective item over one's clothing and more particularly still over the chest and torso to protect one's clothing or apparel while dining. More particularly still the invention relates to a magnetic holding device into which such absorbent napkin is easily inserted or, in other words, which is easily connected to an absorbent or protective napkin and, from which holding device the napkin is readily removable upon the application of a relatively small amount of force applied generally as a downward pulling force on the napkin.

2. Preliminary Discussion

Normally, it is desirable to protect one's clothing from the well known hazard of accidental food spillage during eating, particularly if the diner is wearing business or other formal or semi-formal attire, or merely even clothes which the diner is particularly anxious not to stain, or if dining out at a restaurant, formal banquet, or other function where one wishes to be particularly careful not to stain one's clothes. While certain foods such as pasta, soups, desserts, beverages, or really any food that includes a sauce or gravy, are more likely to leave stains if they drip or splash onto one's clothing, virtually any salubrious or less than salubrious, edible or gastronomical delight can accidentally fall from a fork, knife, spoon, glass, cup or hand while in transit towards the mouth. Spilling of food or drink on a coat, tie, blouse, jacket, and the like is not only untidy, but is also embarrassing not only at the time, but also until such time as the wearer has the opportunity to change the soiled clothing, which may often not be for several hours or more. In fact, spilled food stains are more embarrassing after the fact than at the time of the spillage because of the untidy and careless appearance that stains on one's clothing tend to present. Spilling food is usually forgivable, if only done occasionally. However, wearing food-stained clothing is often not acceptable in general society at any time, even for food service workers.

Bibs for protecting one's clothing are well known, but are normally only used by parents for toddlers or by other relatively young persons and occasionally by the very elderly. Adults usually will simply tuck a cloth or paper napkin into the neck or collar of their shirt or blouse, or else forego any protection at all over the front of their body and simply place a napkin over or upon their lap area. This may be particularly so where the person in question does not wish to appear less than skillful in his or her eating habits, eating being very largely a social skill as well as a biological necessity. Sometimes, when eating particularly messy items, a napkin or absorbent material may be clipped either directly to the apparel of the user or else simply tied around the neck or tucked into the clothing of the user. The clips used frequently have small teeth on their surface or extending from the side of the clip to obtain a better grip on the napkin. One drawback of the use of a clip is that in order for the user to remove the napkin from the clip, either so that the napkin may be used to wipe one's mouth or simply if the user has finished dining and wishes to remove the napkin permanently, the clip must be grasped by the user with one hand so that the jaws or the like of the clip can be opened.

At the same time, the napkin must be pulled or removed from the clip by moving or pulling on it with the other hand. If the napkin has instead been tied with a cord or the like around the neck of the user, it must now be untied. All this tends to attract the attention of others and frequently embarrasses the one removing their napkin if not skillfully done. Such procedures also can be difficult for some users, particularly if one's hands are still in a somewhat soiled condition, or if the user is elderly or has some affliction such as arthritis or the like which makes it difficult to perform these tasks quickly or easily. There remains, therefore, a need for a device which can be used to quickly secure or release a napkin or absorbent protective material from a position over the front of one's body during dining. Any such device should be both attractive and unobtrusive to others, and should be capable of being manufactured inexpensively. The present inventor has conceived of and developed a holding device fulfilling these requirements wherein the napkin is secured between pairs of magnetically activated attractive panels or securing pads secured in turn to the ends of a preferably decorative neck lanyard. The magnetically attractive panels or pads are arranged so that a relatively slight sidewise or more usually downward tension on the napkin will cause it to be released from the holding device, or from between the panels or securing pads, so such napkin may be otherwise used, discarded or retained for further use. Such quick release feature may be particularly useful where one may wish to quickly use the napkin to wipe or protect other portions of the body such as the face, lap or the like, or to use the napkin mopping a spilled beverage or the like.

The invention comprises not only a novel securing device for use with napkins and the like, but also a combination of the napkin securing device of the invention together with a napkin or napkins to be used with such securing device in the form of a kit, system or combination for efficient clothing or personal protection. The napkins as well as the clip can be monogrammed or provided with identifying symbols, logos or the like of providers, sponsors or other organizations to serve as advertising or promotion items for such sponsors. The securing device itself can be composed of any lightly yet securely clamping magnetic clip having two fairly smooth clamping faces arranged in pairs on the two ends of a neck lanyard allowing a napkin or the like to be securely held between such clamping faces, but to be released from secured relationship with merely a single sidewise or more usually a downward tug without tearing or otherwise damaging the napkin, particularly when it is desired to remove such napkin from over the chest area or the front of the user. More particularly, the preferred magnetic clips are formed of or from pairs of plastic pads or tabs which may have an oval configuration with the large portion of the oval worn downwardly and containing in one pad or tab a powerful magnet embedded or encapsulated in the plastic and in the opposing pad a magnetically energizable metal piece embedded or encapsulated in the plastic, which metal piece will tend to be attracted strongly to the magnet. The magnet and magnetically energizable metal, or pole piece, are conveniently embedded or encapsulated in the plastic pads during a molding operation by which the pads are formed or alternatively, and in most, but not all cases, less conveniently by forming such pads in two halves with hollowed out spaces on their interior faces into which the magnet and magnetically energizable metal or pole piece are placed and the two sections of plastic closed over the magnet or pole piece and adhered to one another. The metal pole piece in one pad could alternatively be replaced by another magnet arranged so the polarity of the magnets are opposite to each other. Smaller or less powerful magnets could then be used. However, it has been found that a magnet and opposite metal attractant, or pole piece, are efficient and easier to use. The term "pole piece" is used herein to refer not necessarily to a metal piece that bridges the poles of a magnet and tends to preserve the magnetism, but to a metal piece that may be attracted to or toward a magnet and through which lines of magnetic force may pass drawing the magnetically attractable metal toward the nearest pole of the magnet. Another magnet may constitute a pole piece and indeed the magnetizable metal while drawn to the permanent magnet becomes itself a temporary magnet. The plastic pads or panels in which the magnet and pole piece are embedded or encapsulated must, as noted above, have relatively smooth surfaces to allow relatively free sliding of the napkin between the faces until released from the pads upon the application of an amount of sidewise or downward force insufficient to tear the material of the napkin. The outer face or faces of one or both pairs of panels or pads may have any desired decoration applied thereto preferably in the form of a raised or embossed emblem or the like or a recess for the receipt or insertion of a desired decorative or identifying emblem or label and the lanyard connecting the pairs of magnetic clamping pads may be decorated in any manner in keeping with the napkins with which they may be supplied as a set or later used. Because the pads or tabs preferably physically contain the magnet and magnetisable pole piece they are conveniently referred to hereafter in some cases as front and back, or frontal and interior housings or magnet housings. Because a powerful magnet tends to be thicker than a pole piece used with such magnet and because it is frequently convenient to have the magnet on the outside when worn, the frontal housing will in most cases be somewhat thicker than the interior housing.

3. Description of the Prior Art

The following prior art patents related to magnetic holding devices or other similar products incorporating or demonstrating concepts which may bear upon the present invention are known by the present inventor. None of such devices, however, includes a device for holding a clothing protective material over the front of one's torso while dining as conceived by the present inventor.

For example, U.S. Pat. Nos. 2,557,398 and 2,557,399 both issued to M. O. Teetor on Jun. 19, 1951, entitled "Magnetic Holder for Display Cards," each disclose a magnetic display card holder wherein display cards are held between a pair of magnetic holding units. In the '398 patent, a magnetic attraction is generated between the holding units and a metal plate, rather than between the two holding units, so that the display card is situated between the two holding units, but is not actually held by a magnetic attraction between the holding units. In the '399 patent, the metal plate is omitted, and the magnets are angled so that there is a magnetic attraction between the holding units, and so that the display card is actually held between the holding units by such magnetic attraction. As with most of the magnetic holders in the prior art, however, they are designed to hold the display card as tightly as possible, rather than in a manner wherein the card can be easily slipped out of such units, which slippage is a key feature of the holding units in the present inventor's napkin or bib holder. U.S. Design Patent 378.531 issued to B. Szikszay on Mar. 18, 1997, entitled "Magnetic Document Holder," also discloses an ornamental design for a clip-like magnetic paper or document holder having flanges between which a document may be secured.

U.S. Pat. No. 4,255,837 issued to H. Holtz on Mar. 17, 1981, entitled "Magnetic Clip Device," discloses another clip for magnetically containing sheet-like materials such as memos, cards, and the like. Holt is unique in that the clip is made from two thin magnetic plates or foils having alternating polarity along their faces, which apparently aids in correctly aligning the magnetically attractive plates. See also U.S. Pat. No. 4,258,493 issued to John S. Kettlestrings et al. on Mar. 31, 1981, entitled "Advertising Display Means and Method," which discloses a magnetic holder for holding signs and the like in a vertical orientation, wherein when the magnets are brought into face-to-face alignment, the alternating poles of such magnets line up to create an attractive force. Such holders do not include a smooth or slippery surface over the magnets so that items can be easily slipped out of the holders, however.

U.S. Pat. No. 3,529,328 issued to P. T. Davison on Sep. 22, 1970, entitled "Magnetic Clothespin," discloses a clothespin comprised of an elongated strap having enlarged generally round ends in which a ferrous plug and a magnet are disposed, respectively. When the ends of the strap are brought together, there is a magnetic attraction between the magnet and plug that is strong enough to retain a garment such as a pair of stockings hanging from a clothesline. The clothespin has vinyl outer side cover heat sealed to a vinyl inner side liner, which inner liner has a grain thereon to increase the friction between the device and the item being supported so that it does not detach when acted upon by mild forces such as wind force or the like. Therefore, while Davison teaches a clothespin that is similar to the present invention in that the garment is held by magnetic attraction, Davison does not teach a napkin or bib holder comprised of a lanyard having magnetic holding devices on its ends which lanyard is draped around the neck of the user and wherein the napkin or bib is releasably held by the securing devices over the front of the user's torso. In addition, the present inventor does not score or emboss the inner surface of the holder with a fine grain to increase the friction between the device and the item supported, but in fact intentionally provides a smooth or at least mildly slippery surface between the magnets or between the magnetic casings so that the napkin can be slipped out of the device easily simply by a light tug on the napkin itself.

U.S. Pat. No. 3,577,583 issued to W. R. Amann on May 4, 1971, entitled "Magnetic Clamp," discloses a magnetic clamp for holding sheet material suspended and movable along an overhead track. The clamp has opposed body portions, one of which may be flexed inwardly around its central portion, causing the end of such member to pivot outwardly, opening the magnetic clamp so that sheet material can be easily inserted or removed. Amann therefore teaches a unique means for opening and closing a magnetic clamp; however, the clamp is not designed so that the sheet material can be easily slipped out of the clamp as in the present invention.

U.S. Pat. No. 3,629,905 issued to D. J. Cote on Dec. 28, 1971, entitled "Bread Bag Resealer," discloses an elongated magnetic clip comprised of a pair of opposed members which are fitted over the mouth of a bag to hold such opening closed. A spring steel clip helps urge the members into a closed position. To open the clip, the members are manually pulled apart or slid sidewardly respective to each other. The Cote clip apparently is not designed so that the bag can be easily slipped from between the opposed members upon the application of a relatively small amount of force on the bag, which is a key feature of the present invention.

Various other items utilizing a magnetic clasp are also known. For example, U.S. Pat. No. 3,741,376 issued to R. G.

Brown, et al. on Jun. 26, 1973, entitled "Pocket Holder with Magnetic Clasp," discloses an eyeglass case having a magnetic clasp on one side which is used to secure the holder in a garment pocket with the clasp extending over the outside of the pocket. Magnetic locks are also prevalent, such as shown in U.S. Pat. No. 4,021,891 issued to T. Morita on May 10, 1977, entitled "Magnetic Lock Closure," wherein a magnetic lock having a rod portion is secured in an aperture holding a magnetically attractive element. U.S. Pat. No. 4,447,238 issued to J. D. Eldridge, Jr. on May 8, 1984, entitled "Medical Tubing Holder," discloses a holder for vacuum tubes, electrical cords or the like comprised of a foam backing element having two sections which are held together by a magnetic attraction when the backing is folded. A plastic strip is secured to the backside of the backing element which is wrapped around a tube and then held between the folded magnets. The strip is manufactured with a surface designed to make it extremely difficult to pull the strip out from between the magnets.

U.S. Pat. No. 5,186,373 issued to J. T. Taylor on Feb. 16, 1993, entitled "Connector Assembly for Removably Holding a Glove," discloses a holder having a magnet secured to each of two folded portions for clipping to a garment pocket, while a pair of gloves or like is secured to a Velcro® patch on the outer face of the clip. The magnet in Taylor is therefore used to secure the clip to a pocket rather than to hold an item to the clip as in the present invention. U.S. Pat. No. 5,450,658 issued to J. R. Hicks on Sep. 19, 1995, entitled "Magnetic Sock Holder," discloses a sock holder having encapsulated magnetic panels. A pair of housing members are sandwiched around a portion of the sock material, which members are then secured together during laundering via the encapsulated magnets. No material is actually secured between the magnets, however. U.S. Pat. No. 5,926,925 also issued to J. R. is Hicks on Jul. 27, 1999, entitled "Magnetic Sock Holder," discloses a slight variation of such holder. U.S. Pat. No. 5,895,018 issued to R. G. Rielo on Apr. 20, 1999, entitled "Magnetic Support Attachment" discloses a similar support for holding a kitchen towel or the like with barbs wherein the magnet is primarily used not to secure the towel, but to secure the holder to another magnetic or magnetizable surface such as a refrigerator door, etc.

Various bibs and aprons are also known to the present inventor, such as shown in U.S. Pat. No. 5,220,692 issued to L. Cox on Jun. 22, 1993, entitled "Driver's Apron," which discloses an apron primarily to be worn while driving to protect the driver from accidentally spilled or falling food. The neck strap is secured to the apron by Velcro® type fastening pads so that the apron can be put on or removed using one hand. In addition, the sides of the apron are weighted to help maintain it in place over the lap and legs of the user. While Cox discloses an easily removable apron or bib, Cox does not disclose the use of magnetically attractive holders to secure the neck strap to the protective apron as in the present invention. U.S. Pat. No. 6,079,048 issued to D. F. Campbell on Jun. 27, 2000, entitled "Self-Adhesive Napkin," discloses a napkin for protecting clothing while a person is eating comprised of a sheet of absorbent material, a neck receiving recess, and an adhesive material on the inside surface along the upper edge of the napkin for temporarily securing the napkin to the clothes of a user. Such napkin is temporarily adhered directly to one's clothing, which may be undesirable with respect to some users.

U.S. Pat. No. 5,425,160 issued to W. A. Krapf on Jun. 20, 1995, entitled "Magnetic Paper Clamp and Method of Producing Same," discloses a magnetic clamp for releasably securing sheets of paper and the like comprised of a U-shaped plastic strip with two magnetic strips secured on the inner face of such strip. A radiused fold in the strip acts as a tension hinge so that the magnetic strips can be easily separated for insertion or removal of the sheets of paper therebetween but also so that the tension hinge urges the sections of the strip into a closed position. A method of making such clamp is also disclosed.

U.S. Pat. No. 5,682,653 issued to F. Berglof et al. on Nov. 4, 1997, entitled "Magnetic Fastening Device," discloses a simple magnetic fastener comprised of two pairs of magnetically attractive members interconnected by a U-shaped tubular sheath made from a heat shrinkable plastic. Such fastening device apparently can be used to hold various items such as a nametag or the like, Berglof does not, however, indicate that the magnets are covered with a generally or effectively slippery surface so that materials held by the fastener can be easily removed by tugging on such materials without having to manually open the clamp.

U.S. Pat. No. 6,101,688 issued to A. Marchesi on Aug. 15, 2000, entitled "Magnetic Closure with Casing Made of Nonferromagnetic Material, for Bags, Items of Clothing and the Like," discloses a magnetic closure comprising an outer container, magnetic ring, magnetic flange, and rear plate. The novel aspect of the Marchesi clip is that the casing is thinner in the portion directly over the magnets so that such casing will not interfere with the magnetic adhesion force between the encased magnets. Marchesi does not indicate, however, that the casing should be made of a slippery substance to facilitate easy removal of an item from the closure device.

U.S. Pat. No. 6,226,842 issued to S. C. Wong on May 8, 2001, entitled "Waterproof, Washable Plastic Magnetic Button and a Method for Manufacturing It," discloses a button body having a decorative top face and through holes along its edge portion. A magnet is housed in a cavity in the button, with a steel plate used to cover the back and sides of the magnet. Wong uses a stronger-than-conventional magnet, and in addition, claims that the steel plate concentrates the magnetic force on the face of the button while decreasing the magnetic force on the back face. A method of manufacturing is also provided. U.S. Design Pat. No. 448,703 issued to Y. S. Lam on Oct. 2, 2001; entitled "Convex Magnetic Button," discloses another design for a magnetic button.

U.S. Pat. No. 6,282,760 issued to M. K. Mars on Sep. 4, 2001, entitled "Magnetic Attachment Device," discloses a magnetic attachment device primarily for temporarily attaching items such as name tags and the like to garments having inner and outer magnets with the outer magnet attached to an anchor, and with the pin attached to the anchor via a central passageway. The pin, while detachably secured to a garment, is not designed to be easily removed from the clothing article as in the present invention.

Despite the variety of inventions discussed above, many of which have rather different objectives that than those of the present invention, there remains a need for an improved arrangement for protecting one's apparel from becoming soiled as a result of untidy and embarrassing spills occurring while dining. More particularly, there is a need for a device for securing a cloth or paper napkin, bib, or other absorbent material over the front of one's chest and torso during eating to prevent accidental soiling of an apparel item by spilling or dropping what is being eaten. Such device should make it easy to attach the napkin to the holder, and in addition the napkin should be easily removable from the holder simply as a result of the application of a relatively small kin, wherein it will then be released from the holder without in such as ripping or catching on the holder. The present this need.

OBJECTS OF THE INVENTION

It is therefore a primary object of the invention to provide a device for temporarily holding a napkin, bib, towel, apron or other piece of absorbent material over the torso of a user.

It is a still further object of the present invention to provide a holding device comprised of a lanyard having a pair of gripping members secured on either end, each of such gripping members being comprised of a magnetically attractive section detachably securable to the upper edge or side of the napkin.

It is a further object of the present invention to provide a holder for an absorbent napkin wherein the absorbent material is held by magnetic attraction between two sections of the holder.

It is a still further object of the present invention to provide a holder wherein the absorbent material can be removed from the holder immediately upon the application of a small amount of downward force on the material without requiring any further manipulation of the holding device.

It is a still further object of the invention to provide a magnetic holder for napkins comprised of a housing containing a magnet opposed on the end of a lanyard to a second housing containing a pole piece for said magnet, both housing having substantially smooth napkin contacting surfaces.

It is a still further object of the invention to provide a promotional device in the form of a magnetic napkin holder having an outside surface area arranged for convenient addition of identifying indicia for organized sociological groups.

It is a still further object of the invention to provide a magnetic napkin holder or support for use in supporting a napkin over the front of a human body the magnetic supports of which are provided with napkin contacting surfaces that allow convenient removal of a napkin upon the application of a downward tension insufficient to damage the napkin.

It is a still further object of the invention to provide a lanyard supported magnetic napkin holder or holders for use in protecting the clothing of an individual while dining in which each individual holder is comprised of polymer type housings encapsulating magnets and pole pieces adjacent relatively smooth or slippery napkin contacting polymer surfaces.

It is a still further object of the present invention to provide a kit containing a magnetic holder and at least one napkin wherein one or more of such magnetic holder and/or napkin may include an insignia, logo or other identifying or decorative elements.

It is a still further object of the invention to provide a combination of a napkin or napkins in a package or kit along with one or more sets of lanyard supported magnetic napkin holders in accordance with the invention.

It is a still further object of the invention to provide an attractive, readily saleable kit or package containing in a visible arrangement at least one magnetic napkin holder adapted for allowing quick release of a napkin in a dining emergency or spillage situation or occurrence along with at least one napkin suitable for use with the magnetic holder.

Still other objects and advantages of the invention will become clear upon review of the following detailed description in conjunction with the appended drawings.

SUMMARY OF THE INVENTION

The present invention is essentially a device for magnetically and releasably securing a napkin, bib, apron, or other absorbent protective material over the front of one's chest or upper torso while dining. The device is comprised of a pair of magnetically attractive gripping members secured to opposite ends of a connecting lanyard long enough to fit across the back of one's neck. Each gripping member is comprised of a pair of opposed similarly sized and shaped preferably plastic tabs or housings, each encapsulating a small but powerful magnet or other magnetically attractive element so that when brought together the gripping members are strong enough to hold or support a napkin or similar item therebetween. The inner surface of the tabs or housings is intentionally made smooth or even somewhat slippery to minimize frictional forces between the tabs and the absorbent material. In use, the ends of the napkin are placed between the tabs with the lanyard around the neck of the user, so that the napkin generally covers the chest and torso of the user and will absorb any food or beverage items which might be accidentally spilled upon the upper torso of the user. While the napkin is held securely between the tabs or housings by the magnetic attraction between such tabs under normal conditions, the semi-slippery surface allows the napkin to be easily removed from the holder simply by applying a small degree of force on the napkin. A logo or design is preferably placed on the outer surface of the tabs or housings, so that the device also serves as an attractive advertising, promotion or marketing tool. Kits containing one or more napkins plus one or more of the magnetic holders may be supplied.

BRIEF DESCRIPTION OF THE DRAWINGS

FIG. 1I is a side view of a ring-type fitting arrangement for fastening the tabs or magnetic mountings shown holding a section of napkin between them.

DESCRIPTION OF THE PREFERRED EMBODIMENTS

Figure 1:
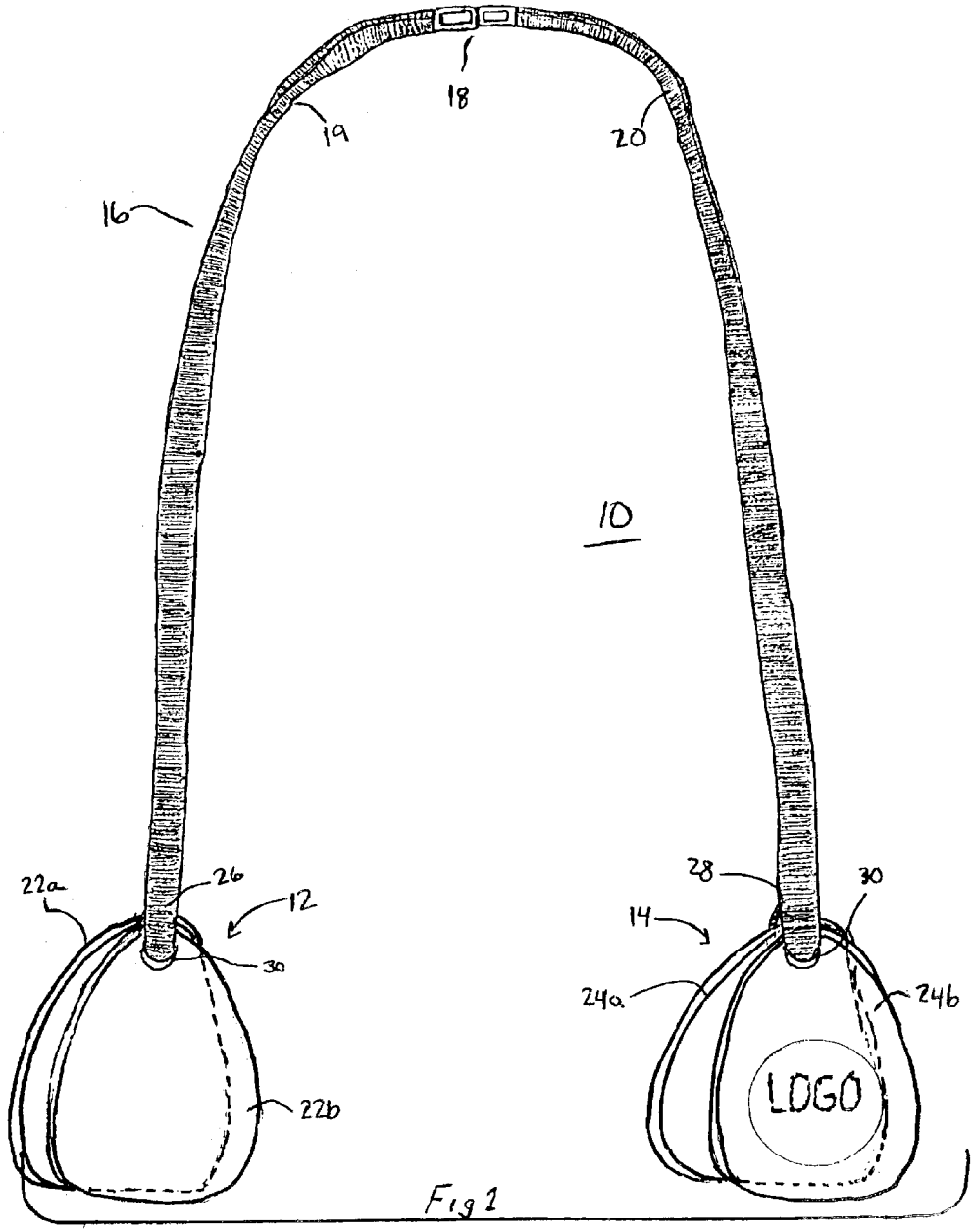
FIG. 1 is an isometric view of the napkin or bib holding device of the invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention is directed to a device for holding a cloth or paper napkin, bib, apron, or the like in place over one's clothing or apparel while eating. The device is comprised of two gripping members connected by a lanyard or a fitting attached to a lanyard said lanyard being long enough to traverse the back of the neck of the wearer. A breakaway safety mechanism may be provided on the lanyard to prevent accidental injury in case of some sort of snagging of the lanyard during use, although the smooth faces of the securing means provides an automatic snag prevention between the lanyard and the napkin as well. Each gripping member is comprised of a pair of preferably similarly sized and shaped tabs or housing members in face-to-face alignment which housings are pivotable on the end of the lanyard or an intermittent fitting laterally relative to each other as well as movable directly away from each other with the application of additional force. Encapsulated in each housing member is either a permanent magnet or a magnetically attractive member so that a magnetic attraction between such magnet and magnetically attractive member strong enough to place pressure upon and retain the cloth or other item between the housings is provided. The magnetically attractive members may either be other magnets themselves or more preferably magnetisable metal pieces, which can be referred to as pole pieces, through which magnetic lines of force will be concentrated or directed so such magnetisable pieces, or pole pieces, are attracted to and held against the magnet in the opposite housing. The inner surface of each of the opposed tabs or housing members is intentionally made smooth so as to minimize the frictional forces between the napkin and the gripping members during use. Preferably the surfaces are therefore semi-slippery, but not truly slippery, since the holders must obtain sufficient purchase or hold upon the napkins to support their weight against downward slippage under normal circumstances. The usual napkin will be formed of a fibrous (so it is absorbent) cellulose band material whether the fibers are fabric or paper fibers. The outer surfaces of the housing members may be adapted to receive virtually any desired marking or decoration, including logos, insignias, monograms, advertising pieces and the like, so that the device may also serve as an effective marketing, promotion or advertising tool. In use, the lanyard is placed around the back of the neck of the user, the housing members are slid apart or otherwise separated, and the top edge of the napkin is inserted between each pair of housing members, after which the housing members are brought back into side-by-side alignment. The napkin will then be supported by the device so that it hangs over the front portion of the user's torso and protects the user's shirt, blouse, coat, or other garment. Under normal usage, the napkin will remain in such position until it is desired or desirable for it to be removed. Removal of the napkin from the device is accomplished simply by applying a small amount of generally downward force on the napkin so that it slides or slips out from between the housing members without any further manipulation of such members being required. The magnetic attraction between the magnetic elements, the thickness of the plastic casing over the magnetic elements, the size of the surface of each element contacting the surface of a napkin and the surface characteristics, i.e. the smoothness or slipperiness of the plastic surface, should be such that an ordinary cloth or paper napkin wilt be securely held by the magnetic holders in ordinary use, but the napkin will slide out of such holders upon application of one quarter to three-quarters of a pound plus or minus an ounce or two of fairly suddenly applied force such as a light hand tug applying this much force. In the case of a longer heavier napkin, the magnetic force may be made greater to accommodate the heavier napkin while still releasing with an additional force of one quarter to three quarters of a pound plus or minus an ounce or two serving to release the napkin may be desirable. Since the napkin itself will on average vary from an eighth of a pound up to half a pound or more, the force which should be resisted with respect to slippage of the napkin may be from one quarter pound at a minimum to as much as a pound or slightly more. This resolves itself into a desired resistance of a napkin normal, or at right angles to the magnetic force between holders, of between about four ounces at a minimum up to, as a practical matter, 20 ounces or one and one quarter pounds. It is convenient usually to refer to the extra force necessary to slip the napkin out of the holders as this refers more directly to the force which a user will apply to the napkin to remove it from the holders. This can be referred to as the "release" force. As will be understood, if the force necessary to detach the napkin from the holder is too great or too little, the intended usefulness of the invention will be severely limited. As a practical matter, where matched sets or packages of napkins and magnetic holders are supplied the strength of the magnetic holders, or their holding power will be matched to the weight and texture of the napkins. Where the holders are supplied for use separately, however, an average for the weight and texture of napkin likely to be met with will be adopted.

Referring now to FIG. 1, there is shown a magnetic holding device 10 in accordance with the principles of the present invention primarily for holding a cloth or paper napkin in a position covering the human chest and torso while dining, although the device may also be used to hold a towel, bib, apron, or other similar protective and absorbent material in such position. Holding device 10 is generally comprised of a pair of gripping members or magnetic holders 12 and 14 connected by a lanyard 16. Lanyard 16 preferably includes a breakaway metal or plastic middle connector or clasp 18 of a type well known to those skilled in the art that will disconnect the lanyard into two parts or sections if the tension on the lanyard is increased beyond a predetermined breaking point or disconnect tension. Therefore, if the lanyard accidentally becomes caught or snagged on something, it will separate into two parts 19 and 20 rather than possibly causing injury to the user. Other types of detachable or breakaway connectors, such as made from Velcro or rubber, may also be used. While it is preferred to use the breakaway connector 18, since the smooth faces of the magnetic mountings also enable the device to easily separate or detach from a napkin, there is in effect also an inherent safety breakaway system.

Gripping members 12 and 14 positioned on opposite ends of lanyard 16 are comprised of a pair of adjacent pads, tabs or, as usually referred to herein, housing members, with housing members 22*a* and 22*b* secured on the first end 26 of lanyard 16, and housing members 24*a* and 24*b* secured on the second end 28 of lanyard 16. Housing members 22*a-b* and 24*a-b* are secured to lanyard 16 in such a manner that they are pivotable respective to each other both laterally, i.e. are slidable sideways respective to each other and directly away from each other pivoting about the point where they are connected at one end to the lanyard. As described below, sideways sliding or lateral movement between the housing members allows such members to be slid apart for the insertion of a napkin therebetween rather than trying to separate the housing by attempting to pull against the force of the magnetic attraction, which is considerably more difficult. In the embodiment shown, apertures 30 are provided in housing members 22*a-b* and 24*a-b* through which apertures the first and second ends 26 and 28 of lanyard 16 are respectively threaded or passed and then looped back upon themselves and the ends are then heat secured or sealed onto an adjacent portion of the lanyard. The end of the lanyard could also be doubled back and secured to itself in any convenient manner such as by use of a sleeved fitting, the use of an adhesive or even by tying. The loop formed provides in effect a ring or semi-lateral ring at the end of the lanyard upon which the two tabs 22*a* and 22*b*, and 24*a* and 24*b* may be laterally rotated with respect to each other. Other means for attaching housing members 22*a-b* and 24*a-b* to the lanyard in slidable or rotatable relation to each other, such as an actual intermediate ring or a clasp, may alternatively be used. The length of the lanyard is preferably about 18 inches in length, but may be from about 16 to 20 inches in length to hold a napkin in a serviceable position or height upon the front of the torso of the user above the user's lap. Extra long napkins may be supplied so that they extend down the front and then over the lap of the user.

Each housing member 22*a-b* and 24*a-b* is preferably generally flat and has an inner side 32 and an outer side 34. See FIGS. 3*a* and 3*b*. The housing members may be provided in a variety of sizes and shapes, such as the generally round, semielliptical or oval shape shown in the majority of the FIGS., and are preferably made from a rigid material such as a polymer or plastic. The housings could also be made in special shapes for special uses or more likely for special users. For example, they might be in the shape or configuration of the logo of a restaurant or a sponsoring organization. They could also be formed in the shape or likeness of a breed of cat, dog or other domesticated or wild animal or bird or almost any other representation a napkin user might desire. They are preferably outlined in a fairly regular, smooth or even sided lateral configuration in order to guard against catching the sides of the figures upon each other as the pieces are rotated laterally into clamping position over or against opposite surfaces of a napkin.

Figures 2A, 2B, 2C, 2D, 2E, 2F, 2G, 2H, 2I, 2J, 2K, 2L:
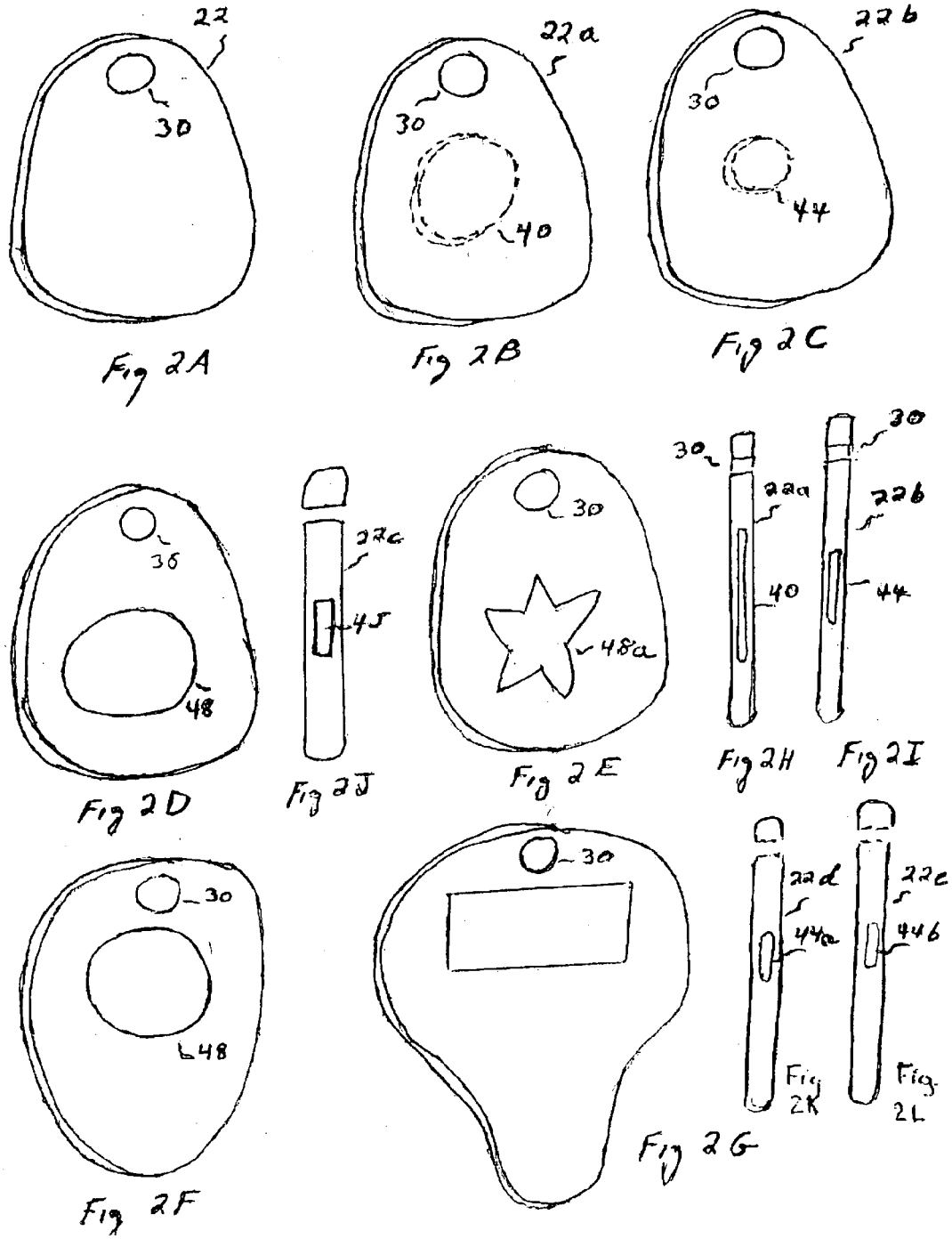
FIG. 2A is an isometric lateral view of one housing of a pair of magnetic housings of the invention illustrating the general size and shape thereof as well as the essentially smooth surface of such housing.
FIG. 2B is an isometric lateral view of the second pair of magnetic housings shown similarly to that of FIG. 2A, but partially in phantom to illustrate a metal pole piece within the interior of such housing.
FIG. 2C is an isometric lateral view of a magnetic housing such as that shown in FIGS. 2A and 2B but wherein there is shown in phantom a small powerful magnet which interacts with the pole piece shown in FIG. 2B.
FIG. 2D is an isometric lateral view of a magnetic housing similar to that shown in FIGS. 2A through 2C illustrating a depression on the outer surface for receipt of a label or the like minimizing the likelihood such label will be peeled off or otherwise lost or damaged.
FIG. 2E is an isometric lateral view of a magnetic housing similar to that shown in FIG. 2D wherein the depression in the surface is in a star configuration.
FIG. 2F is an isometric lateral view of a magnetic housing similar to that shown in FIGS. 2A through 2E, but wherein the upper portion of the housing is expanded and a depression in the surface for receipt of a label is positioned more toward the upper portion.
FIG. 2G is an isometric lateral view of a magnetic housing similar to that shown in previous FIGS. 2A through 2F but wherein not only is the upper portion of the housing expanded but the depression in the surface is not only expanded, but formed in a rectangular rather than a curvilinear shape.
FIG. 2H is a partially broken away side elevation of one of a pair of magnetic housings incorporating a pole piece, such as shown in FIG. 2*b*.
FIG. 2I is a partially broken away side elevation of the other magnetic housing for cooperation with that shown in FIG. 2H and incorporating a small, relatively thin, powerful magnet.
FIG. 2J is a partially broken away side elevation of another magnetic housing containing a thicker small powerful magnet for use with the magnetic housing shown in FIG. 2H, the plastic housing being thicker to accommodate the thicker dimension of the small powerful magnet.
FIG. 2K is a partially broken away side view of one of a pair of magnetic housings each containing a substantially similar small powerful magnet.
FIG. 2L is a side view of the other of the pair of magnetic housings each incorporating a small powerful magnet and intended for use with the magnetic housing.

Representative illustrations of typical magnetic housings each with encapsulated magnetic pieces, comprised of either small powerful magnets or magnetic lines of force conducting, or concentrating, pole pieces are illustrated in FIGS. 2A through 2L. FIGS. 2A through 2L show plastic mountings or housings 22*a* and 22*b* (See FIG. 1) of various shapes and sizes. FIG. 2A is an isometric lateral view of the exterior of an unadorned or undecorated magnetic mounting, or housing, 22 having a smooth face which will not tear or otherwise damage the surface of a napkin as such napkin is pulled from between the magnetic mountings or housings as shown or illustrated in FIG. 6. FIGS. 2B and 2C are isometric views of the two housings or mountings 22*a* and 22*b* also as shown in FIG. 1 on both ends of the lanyard 16, one of which housings, 22*a*, shown partially in phantom, incorporates or has encapsulated therein a magnetizable or magnetic line conducting pole piece 40 and the other of which 22*b*, also shown partially in phantom, incorporates a small powerful magnet 44 which when within a critical distance of the pole piece 40 in mounting 22*a* will draw the two mountings or housings 22*a* and 22*b* together with considerable force.

When brought close to each other, the strong magnetic field of the magnet induces a similar magnetic field in the metal piece and the two are drawn together in a single magnetic field. In effect, the pole piece becomes a temporary magnet or continuation of a magnet. For this reason, two permanent magnets may also be used as long as their poles are aligned with opposite poles adjacent. Consequently, it is usually more convenient to use a pole piece, since the temporary magnet of a metal pole piece is, in effect, self-aligning. The force exerted upon a normal or average thickness napkin between the two magnetically attractive housings should be sufficient to resist a downward measured force normal or at right angles to the force between the magnetic housings of approximately one quarter to three quarter pounds greater than the weight of the napkin itself, but to release the napkin or let it slide from between the magnetic housings upon a normal force application of extra force of approximately three quarter or more pounds. The force resisted by the napkin normal to the magnetic housings will be essentially the friction developed between the napkin surfaces on both sides with the magnetic housings on both sides and is dependent upon the thickness of the napkin, the surface characteristics of the contacting housing surfaces, the strength of the magnet 44 and its distance from the pole piece 40 including the thickness, in addition to the thickness of the napkin, of plastic or polymer overlying the surface of the magnet 44 and the surface of the pole piece 40. The preferable force resisted for a magnetic holder designed for a normal cloth napkin weighing about four ounces or one quarter pound is one half pound to one pound including the weight of the napkin plus or minus one or two ounces.

The magnet 44 and pole piece 40 are conveniently embedded within or encapsulated within the polymeric housings 22*a* and 22*b* during hot molding or chemical polymerization of the housing material which may be formed, as familiar to those skilled in the art, of plastic by polymeric molding, i.e. while polymerizing in a mold, by hot molding, i.e. solidifying in a mold or by extrusion into a suitable mold. Such mold must have a smooth internal face on the interior side of the housings and will be arranged for insertion of the magnets and pole pieces into the plastic either before or after filling of the molding chamber with polymer or plastic. While there will preferably be a separate magnet housing and pole piece housing, two opposed magnet housings may also be used making certain that opposite poles of the magnets are arranged to be opposed during use so that the magnets are drawn together rather than repelled from each other. As will be understood, the force between two magnets will be arranged or calculated to be essentially the same as between a pole piece and a magnet contained in opposite housings.

FIG. 2D is an isometric lateral view of the outside of a magnetic housing in accordance with the invention showing a depression 48 in the surface into which a label or the like may be placed, which label may be a so-called domed label or the like. Such depression will normally have a flat bottom. FIG. 2E shows an isometric lateral view of the front of a similar magnetic housing having an alternative shape depression 48*a* in the front side of the housing shown in the shape in this example of a five-pointed star, but which could be virtually any shape. The napkin holders of the invention make attractive souvenirs or promotion items for many organizations such as large or small corporations, other business organizations, military and veteran organizations, fraternal organizations and the like. These can be referred to broadly as societal organizations. The identifying shields for many of such societal organizations are of particular shapes. In each case, however, it is usually desirable for the label or identifying decal, dome label or other indicia be contained in at least a slight depression to minimize the likelihood of removal of said indicia by peeling or the like, either deliberate or accidental.

FIG. 2F is an isometric lateral view of the front side of a magnetic housing having an expanded upper section which can provide an expanded depressed area 48 for the placement of a suitable logo or the like. Frequently, in all the representations there will be a similar depression on the opposite side of the combined housing, i.e. on the normal inside or inner surface, in which will be placed the Trademark for the item itself or more correctly for identifying the source of the item itself, for example "Dresskerchief," the expected Trademark under which the holder of the present invention as well as kits containing the napkin holder and suitable napkins are anticipated as likely to be distributed. FIG. 2G shows in an isometric lateral view of a further alternative shape for one of the magnetic housings in accordance with the invention having a very much expanded upper section plus a rectangular depression for the receipt of a suitable legend, slogan, symbol or whatever the purchaser or distributor may desire. It may be desirable to display the Trademark for the holder of the invention as well as any combined handkerchiefs in depression on the inside surface of one or both pairs of the individual housings of the magnetic holders of the invention.

FIGS. 2H and 2I are sectional side views of a pair of magnetic housings 22*a* and 22*b* showing and encapsulated pole piece 40 in housing 22*a* and a small powerful magnet encapsulated in housing 22*b*.

FIG. 2J is a sectional side view of a preferred frontal housing 22*c* having a thicker more powerful magnet 45*a* and a thicker housing than shown in FIG. 2I. This housing 22*c* will be combined with the housing 22*a* as shown in FIG. 2H and as noted is preferred over the housing 22*a* shown in FIG. 2H, especially when heavier napkins are involved.

FIGS. 2K and 2L are sectional side views of a pair of magnetic housings 22*d* and 22*e* having a pair of magnets 44*a* and 44*b* encapsulated in them with the poles of the magnets disposed opposite to each other so that the two magnets attract each other rather than repelling each other. Since the attraction of the two magnets 22*d* and 22*e* is essentially cumulative, assuming that the strength of the magnets is per weight of magnet essentially the same as in the previous examples, the magnets 22*d* and 22*e* need to be only partly as large as magnets 44 or 45 shown in FIGS. 2I and 2J, other things being equal, in order to attain the same magnetic attraction.

Figure 3A:
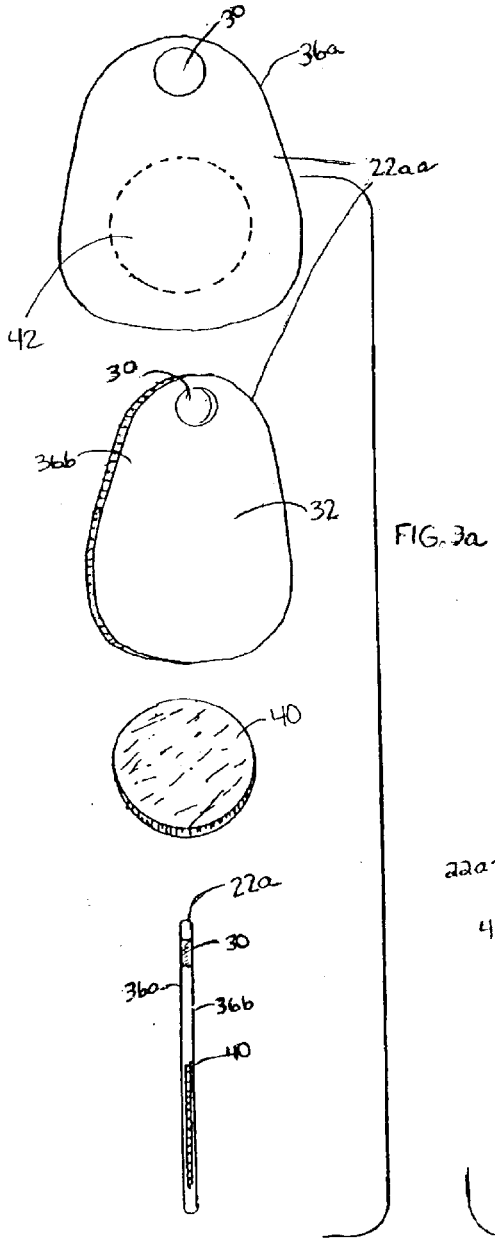
FIG. 3*a* illustrates the separate components of one of a pair of adhesively held together housing members containing an attractable metal section or pole member forming one of an alternative embodiment of the gripping members of the holding device of the invention shown in a three part exploded or disassembled view above and in a single broken away side view below.
Figure 3B:
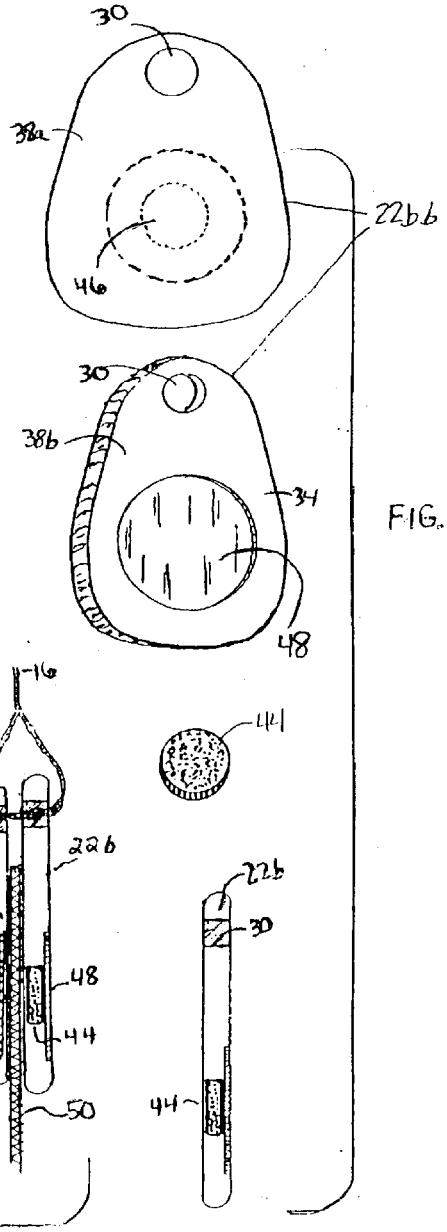
FIG. 3*b* illustrates the other components of the adhesively held together housing member of the pair of adhesively held together housings containing a small powerful magnet forming one of the gripping members of the holding device of the invention shown in a three part exploded or disassembled view above and a single broken away side view below.

As shown in FIGS. 3*a* and 3*b*, which illustrate an alternative construction of housing members 22*a* and 22*b*, respectively, which construction is essentially identical to housing members 24*a* and 24*b*, the inner and outer sides 32 and 34 may be formed of separate pieces or sections which are subsequently permanently joined to form the housing members. In FIG. 2*a*, housing member 22*a* is formed of first and second panels 36*a* and 36*b*, while in FIG. 2*b* housing member 22*b* is similarly shown formed from first and second panels 38*a* and 38*b*. Encapsulated or contained in each housing member 22*a-b* and 24*a-b* is a permanent magnet or magnetically attractive member or attractant, usually a magnetisable metal piece or slug. Referring again to FIGS. 3*a* and 3*b*, magnetically attractive metal slug 40 is encapsulated in aperture or cutout portion 42 in housing member 22*a*, while permanent magnet 44 is encapsulated in cutout portion 46 in housing member 22*b*. In use encapsulated slug 40 is rotated laterally into position in its housing 22*a* immediately adjacent magnet 36 in housing member

Figure 4:
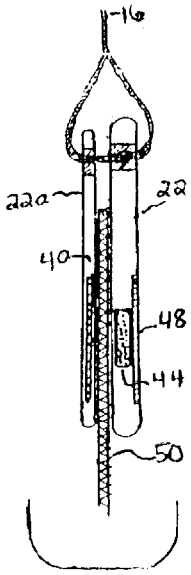
FIG. 4 is a side view of one of the gripping members of the holding device of the invention with the housing members secured to one end of a lanyard and showing a portion of a napkin or bib secured between the housing sections each of which is broken away to illustrate the magnetically actuated members within as well as a depressed or cut out label area on the surface of the magnet containing member.
Figure 5:
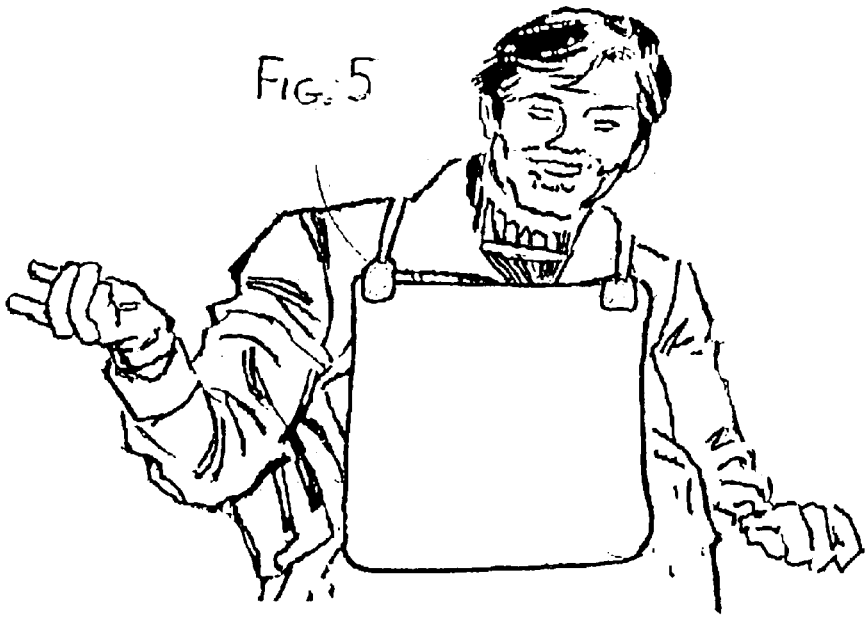
FIG. 5 is an isometric view of the holding device of the invention as utilized to support a napkin across the upper front torso of a user.

22*a*. Such magnets or magnetically attractive members or pole pieces are preferably comprised of thin flat circular discs having a diameter slightly less than the diameter of the housing members, which slugs or discs are aligned with the magnetic north pole of the magnet facing inwardly in holding position and, if two magnets are used, the north pole of the other magnet facing outwardly. A magnetic attraction is therefore effectively provided between the housing members 22*a* and 22*b*, which attraction, as shown in FIG. 4, tends to pull or urge the inner faces 32 of housing members 22*a-b* inwardly or towards each other until they are aligned side-by-side. Permanent magnets or magnetically attractive metal slugs are similarly secured in housing members 24*a* and 24*b*, so that the inner faces 32 of such members are also held in adjacent or side-by-side alignment when rotated into holding position. Additional magnets or magnetic attraction members may be provided in the housing members if desired. Preferably, sections 36*b* and 38*a* which form the inner sections of housing members 22*a* and 22*b*, respectively are thinner than outer sections 36*a* and 38*b* so that both magnetically attractive member 40 and magnet 44 are positioned nearer to the inner surfaces 32 of the housing members. This may help ensure that the plastic or other material forming gripping members 12 and 14 does not interfere with the magnetic attraction, between such members. Very powerful small disk type magnets are commercially available and when combined with an opposed magnetizable metal or other magnetizable material disk can apply a very powerful force. It is for this reason the tabs or housings are slid sidewise at right angles to the magnetic attraction to either slide the tabs into position over the edge of a napkin or to release the napkin if it is not desired to bodily slide such napkin from between the aligned tabs. In the case of the magnets and pole pieces encapsulated in molded housings as shown in FIGS. 2A through 2K the magnet and pole pieces may also be desirably spaced within the housings nearer the face of the housing designed to contact the napkin between the housings during use.

Another feature adding to the desirability of the invention as noted above is that various designs and the like may be placed on the outside surfaces of the housing members 22*a-b* and 24*a-b*. Such designs may include, but are not limited to, company names, logos, symbols, insignias, fraternal crests or insignia, band or celebrity names, or other original designs. Such designs may be painted, adhered or otherwise attached to the devices in any manner. However, in one embodiment, as shown in FIG. 2*b*, a recess 48 is molded in the surface of the outer side 34 of housing member 22*b*. Such recess 48 is provided as a receptacle for the attachment, usually by an adhesive, of a flat or domed monogram, team or company logo, or other advertising device. The recess 48 assists in preventing the edges of the label or adhesive layer from accidentally or intentionally being pulled off the holding device. Recesses may of course typically be provided in the surface of the outer sides of the other holding members, or several smaller recesses may be provided in each holding member to accommodate several advertising or marketing indicias.

FIG. 4 is a sectional view of napkin or cloth 50 secured between housing sections 22*a* and 22*b* of gripping member 12. The magnetic means 44 and metal attractant or pole piece 40 are shown in the plastic of the tabs as well as an inserted logo piece 48 partially embedded on the outer side of the tab 22*b*. The magnetic attraction between members 22*a-b* and 24*a-b* together must be strong enough to support napkin 50 in a position hanging or resting across the chest and torso of the user, such as shown in FIG. 4. Of particular importance in the present invention is that the finished surface of the inner sides 32 of each of the housing members 22*a-b* and 24*a-b* is as smooth or friction free as possible. In contrast to other magnetic holding members in the prior art, wherein the inner surfaces are rough or grainy to increase the friction between the device and the item being held by such members, in the present invention it is desired that the surface be smooth so that the napkin or bib does not catch or snag on such surface. This in turn allows the napkin to be unrestrictedly and easily removed from the holding device simply by tugging on the napkin itself, without requiring further manipulation of the holding device or ripping or tearing of the napkin. The inner opposing surfaces of the pairs of gripping members should be substantially flat or planar so they fit intimately against opposite sides of the napkin to attain a good grip upon it. The surfaces could be slightly concave and convex respectively providing a somewhat better grip, but causing possibly more chance of difficulty in rotating the two sections into and out of opposition to each other. The plastic of the housings 22*a* and 22*b* is shown in FIG. 4 as being transparent so the magnet 44 and pole piece 40 can both be seen. Alternatively, FIG. 4 could be considered cut away to show these two structures. If the plastic is not transparent the embedded or centrally contained magnetic structures would not be visible and housing sections 22*a* and 22*b* would appear as in FIGS. 9, 10 and 11. In this regard, FIG. 9 in a side view of one of the magnetic securing means of the invention over a napkin similar to that shown in FIG. 4 except the inside of the magnet and pole piece inside the plastic housings or tabs is not shown and a domed transparent logo arrangement 61 and 62 on both outer sides of the magnetic securing tabs or housings of the invention is shown instead. A domed logo is a relatively recent innovation in which a relatively thick transparent plastic covering or dome is placed over a logo, advertisement or picture for which a rich, expensive appearance is desired on upscale goods or documents.

To use the device of the invention, lanyard 16 of the holding device is draped across the back of the neck and over the shoulders of the user. Lanyard 16 should be long enough so that holding device holds a napkin or bib near the upper chest area of the user, so that such lanyard will typically have a length of approximately 18 inches. The housing members are then separated, preferably by sliding such members sideways or laterally with respect to each other so that the upper ends of a napkin can be inserted between the housing members. The housing members could also be simply pulled apart against the power of the magnetic attraction, although, it is invariably less difficult to simply slide the members apart. To insert the napkin between the separated housing members, it is simply placed against the inner surface of one of such members, usually the inner member containing the pole piece, after which the other housing member is slid back into side by side alignment so that the outer surface of one the housing members is resting against the chest or clothing of the user, the napkin is between the inner surfaces of the housing members, and the outer surface of the other housing member, preferably showing the logo on the outer surface, is visible along the front of the napkin. After the napkin is secured between one of the gripping members, the other side is then attached to the other gripping member so that the napkin is supported by the holding device and extends down along the front of the user's torso or chest, and, if desired, lap area depending upon the dimension of the napkin or other absorbent material. When it is desired to remove the napkin, such as for an intended use such as to mop up a spilled beverage or a like substance, a small amount of generally downward force is applied on the napkin, which will cause it to slip from between the gripping members. The smooth inner surface of the housing members allows the napkin to be unrestrictedly pulled or removed from the device at any time, yet the magnet attraction is strong enough to secure the napkin in place across the chest of the user as long as is desired. The invention being used to hold a bib or napkin in the manner described above eliminates the need to manually tie a napkin around a persons neck, stuff or insert the protective material into a persons shirt, coat, collar, tie, or dress to provide protection from spillage while dining.

Figure 6:
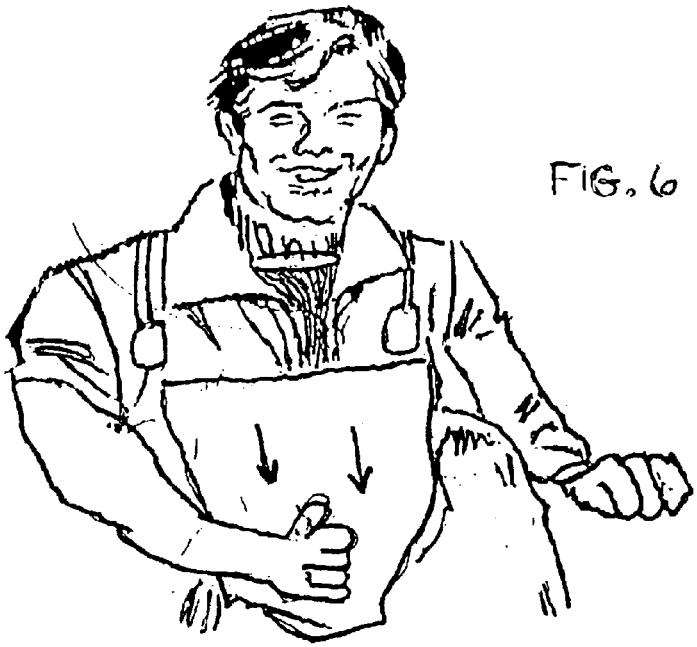
FIG. 6 is an isometric view of the holding device of the invention similar to FIG. 5 except showing the napkin being removed from the holding devices held around the neck of the user by a downward tugging motion.
Figure 7:
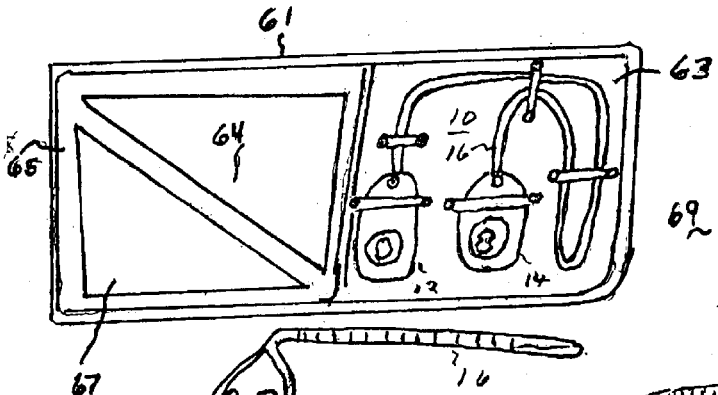
FIG. 7 is a plain view of a container having a compartment at one end containing one of the napkin holders of the invention neatly arranged in the container and held in place by straps or ties plus, in a second compartment or section, a napkin or set of napkins designed for use with the holder.
Figure 8:
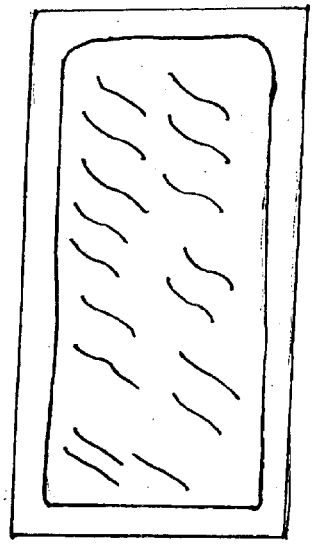
FIG. 8 is a plain view of a container top having a transparent center section so that when the top is mounted upon the container of FIG. 7 the contents can be seen through the transparent center section.

FIG. 7 shows a packaging or box 61 having a magnetic napkin holder 10 in accordance with the invention in one section 63 of the box and at least one napkin 64 provided for use with the napkin holder in a second section 65 of the box or package 61. In FIG. 6 two napkins folded into conventional triangular configuration are shown packed side by side and it will be understood the additional napkins may be contained under the two shown. If a plurality of napkins are included in the package usually additional napkin holders 10 will be included. A lid, not shown, or alternatively shrink-wrap plastic wrapping, may be provided over the box or package 61. Preferably at least the top napkin in the package will have an attractive design on it and the magnetic napkin holder will preferably also have an attractive small picture or other preferably domed logo, monogram or the like on one or more outer surfaces. Domed logos 61 and 62 are shown on both housings 12 and 14. Packages such as shown in FIG. 7 are attractive not only as general consumer items, but also as premium-type goods provided for advertising purposes. FIG. 8 shows a lid or upper partially transparent cover 69 having a transparent window made from cellophane or other transparent material so the set of napkins and napkin holder can be viewed from outside the package. Note that the logos on the surface of the holders will be clearly visible from the top. A further convenient and reusable packaging may be provided by placing both the napkins and the magnetic holders in a large resealable plastic envelope such as the so-called "zip-lok®" bag.

Figure 9:
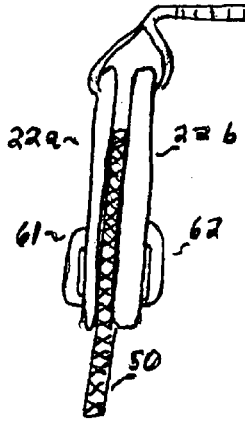
FIG. 9 is a side view similar to FIG. 4, but without showing the interior of the holding tabs and in addition showing a side view of a domed logo on the outer surfaces of both of the tabs or housings of the securing device of the invention.

FIG. 9, as noted above, shows one of the ends of the magnetic device from the side as also shown in FIG. 4 showing the napkin between the two tabs, or housings, with domed logos or monograms 61 and 62 on the outer surfaces. It can be seen in both FIG. 4 and FIG. 9 that the inside contacting surfaces of the tabs are substantially flat so they fit closely against the napkin between them. It will be understood in addition that these surfaces as shown are substantially smooth so the napkin can be easily pulled from between them.

Figure 10:
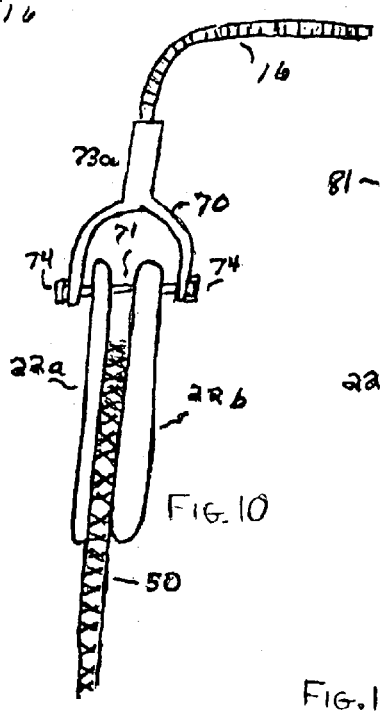
FIG. 10 is a side view of a stirrup-type fitting arrangement for fastening the tabs to the end of the lanyard.

FIG. 10 shows one end of an alternative version of the lanyard of the invention in which the housings 22*a* and 22*b* instead of being strung directly on the end of the lanyard are pivotable upon a stirrup arrangement or fitting 70 on the end of the lanyard. While not necessary, such arrangement enables a freer pivoting and also may provide a more fancy and upscale look to the entire device. The pivot member 71 of the stirrup arrangement or fitting should be somewhat more than just large enough to accommodate the opening in the magnetic tabs or housings so some play in passing the tabs or housings over a napkin is possible. The pivot rod or member 71 may be held in the stirrup by suitable end fittings 74. The stirrup fitting itself may be attached to the end of the lanyard in any suitable manner such as, for example, the compression fitting 73 which as shown comprises a part of the stirrup fitting. As will be understood, the fitting 70 may be made from gold or silver or gold or silver-plated metal if a fancier upscale look is desired.

Figure 11:
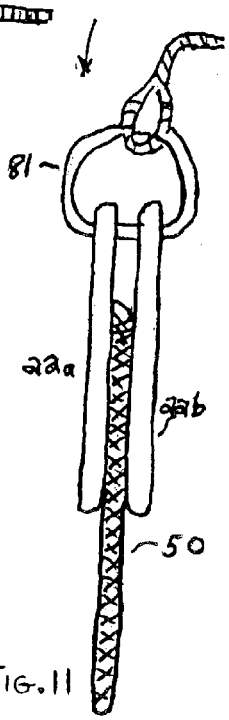

FIG. 11 shows another arrangement for holding the housings 22*a* and 22*b* on the lanyard 16 using an intermediate ring 81 which may be constructed in any suitable manner including a construction like a key ring.

Although the present invention is designed to offer a form of protection for one's clothing and apparel while dining, such device is also extremely useful to health care workers. Nursing home patients, hospital patients, seniors, disabled and handicapped persons having a need to wear a napkin or bib while eating or in some instances while being fed by a health care provider could also benefit from the device. Parents with young children can also quickly place a bib on such children either at home or on the road using the device. Upscale establishments, such as four star restaurants, shipboard dining, first class air travelers, are often pampered by waiters, maitre de's and flight attendants would also find the present device useful not only to protect the clothing of diners but also as an means for advertising the establishment, as any logo, symbol, insignia and the like may be placed on the outer sides of the gripping members or even on the lanyard portion of the device. In addition, since the holding device is removable from the napkin or bib, it does not act as a hindrance to laundering of such items if made from a cloth or washable material so that they may used over and over and therefore does not contribute to the serious problem of overburdened landfills in today's society due to the use of multiple throwaway items.

It is also important to protect the human body from any adverse effects of magnetism by placement of the encapsulated magnetic housing members across the chest of the user. Typically, only one of the housing members will hold a magnet while the other will hold a magnetically attractive slug. Therefore, the magnet will preferably be placed in the housing member that fits over the front of the napkin during use so that the other housing member is situated between the user and such magnet. Optionally, a protective barrier may be placed on the backside of the housing members to further block the magnetic field. While exposure to minimal magnetic fields is generally not considered harmful, patients having medical conditions such as a pacemaker inserted in the chest cavity or the like are typically instructed to avoid direct contact with such fields if possible as they could change at least temporarily the timing of such device. For this reason it may be desirable to mark the securing device in which the magnet is placed so it can be worn outer most. If the magnet is in the outside housing and the larger diameter pole piece is embedded in the inside housing, the magnetic field extending inwardly will be considerably mitigated. Furthermore, while the magnetic attachments are coupled the magnetic lines of force tend to be concentrated through the magnet and adjacent pole piece or opposed magnet decreasing the magnetic flux in the vicinity.

As will be recognized from the above, the magnetic napkin holder of the invention as well as the combined napkin and holder combination of the invention supplied in a package or otherwise provides a very attractive as well as useful appurtenance to dining particularly when particular staining foods or drinks are being ingested or imbibed. The device or combination of the invention is not only highly useful but also attractive in both concept and use of it can be made for a relatively small cost. In fact, the device is useful as an advertising medium which can be given away as premiums, yet may be made of expensive materials with significant decoration so as to become a luxury item where desired.

While the present invention on has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A holding device for removably holding a napkin over the front of the body or torso of a user comprising:

(a) a lanyard having two ends and sufficient length to extend around the neck and over the shoulders of a human body, (b) a pair of clamping devices secured to the ends of the lanyard in a pivotable relationship, each said clamping device being comprised of first and second sections which are in opposed alignment and which are pivotably connected to the lanyard, at least one permanent magnet being embedded in one of the sections and at least one magnetically attractive metal element embedded in the other section for creating a magnetic attraction between said sections.

2. The holding device as in claim 1 wherein the inner surfaces of the sections have a substantially slippery or smooth surface so that items held in the clamping devices can be easily removed therefrom without snagging or damaging the item.

3. The holding device as in claim 2 wherein opposing surfaces of the opposed clamping sections are substantially flat so such opposed surfaces are enabled to fit closely against a napkin between them.

4. The holding device as in claim 3 wherein the first and second sections of the clamping devices are strung directly on the ends of the lanyard.

5. The holding device as in claim 3 wherein the first and second sections of the clamping devices are connected to the lanyard by a separate fitting on the end of such lanyard.

6. The holding device as in claim 1 wherein one of the sections of each of the clamping devices contains an embedded permanent magnet and the other contains a magnetizable metal plate.

7. The holding device as in claim 1 wherein both of the sections of each clamping device contains an embedded permanent magnet, the two magnets being arranged with respect to each other with opposite polarity.

8. The holding device as in claim 5 wherein the fitting holding the two sections of the clamping device is a stirrup fitting.

9. The holding device as in claim 8 wherein the fitting is attached to the end of the lanyard in the manner of a compression fitting.

10. The holding device as in claim 2 wherein at least one of the outer surfaces of the first and second sections of the clamping devices are provided with domed decorative material.

11. The holding device as in claim 3 wherein the magnetic elements are encapsulated in the sections when the sections are in a plastic state.

12. The holding device as in claim 3 wherein the magnetic elements are incorporated between two halves of the sections adhered together.

13. The holding device as in claim 3 wherein the clamping of a napkin between the clamping devices can be overcome and the napkin slid from between such devices by a normally and additionally applied force of 2 to 14 ounces.

14. The holding device as in claim 13 wherein the clamping of a napkin can be overcome by an additional applied force of 4 to 12 ounces.

15. The holding device as in claim 13 wherein the clamping of a napkin can be overcome by an additionally applied force of 6 to 10 ounces.

16. A retail package containing a magnetic napkin holding device comprising:

(a) a lanyard having first and second ends upon which are secured a pair of clamping devices each comprised of first and second sections in opposed alignment pivotably connected to the lanyard, each pair of clamping devices having at least one permanent and one magnetically energizable metal magnet embedded in opposite sections, (b) at least one napkin, (c) a package containing the magnetic clamping device and napkin in separate sections of the package.

17. A retail package in accordance with claim 16 wherein the clamping devices are comprised of flat plastic housings in which the magnetic material is embedded.

18. A retail package in accordance with claim 17 wherein the plastic housings have smooth inside contact surfaces for contacting and holding the at least one napkin between them by magnetic force between the housings.

19. A retail package in accordance with claim 18 wherein the opposing smooth inside contact surfaces are substantially flat.

20. A retail package in accordance with claim 19 wherein the plastic housings are attached directly to the lanyard.

21. A retail package in accordance with claim 18 wherein the package contains more than one napkin.

22. A retail package in accordance with claim 19 including a transparent upper closure for the package whereby to show off the contents.

23. A retail package in accordance with claim 17 wherein the force resistible by the magnetic housing normal to a napkin between the housings is 4 to 12 ounces.

* * * * *